US011371294B2

(12) United States Patent
Brown

(10) Patent No.: US 11,371,294 B2
(45) Date of Patent: Jun. 28, 2022

(54) RELEASABLE RATCHET LATCH CONNECTOR

(71) Applicant: Dril-Quip, Inc., Houston, TX (US)

(72) Inventor: Lucas E. Brown, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 17/049,852

(22) PCT Filed: Apr. 23, 2019

(86) PCT No.: PCT/US2019/028700

§ 371 (c)(1),
(2) Date: Oct. 22, 2020

(87) PCT Pub. No.: WO2019/209814

PCT Pub. Date: Oct. 31, 2019

(65) Prior Publication Data

US 2021/0131195 A1 May 6, 2021

Related U.S. Application Data

(60) Provisional application No. 62/661,706, filed on Apr. 24, 2018.

(51) Int. Cl.
*E21B 17/06* (2006.01)
*E21B 23/00* (2006.01)
(Continued)

(52) U.S. Cl.
CPC ..... *E21B 17/06* (2013.01); *E21B 23/00* (2013.01); *E21B 17/042* (2013.01); *E21B 33/04* (2013.01); *E21B 34/045* (2013.01)

(58) Field of Classification Search
CPC ..... E21B 17/06; E21B 17/042; E21B 17/043; E21B 23/00; E21B 33/04; E21B 34/045
See application file for complete search history.

(56) References Cited

U.S. PATENT DOCUMENTS 4,830,408 A 5/1989 Reimert
5,255,746 A 10/1993 Bridges
(Continued)

FOREIGN PATENT DOCUMENTS

EP 0957233 A2 11/1999

OTHER PUBLICATIONS

International Search Report and Written Opinion issued in related PCT Application No. PCT/US2019/028700 dated Aug. 29, 2019, 14 pages.

(Continued)

*Primary Examiner* — Giovanna Wright
*Assistant Examiner* — Yanick A Akaragwe
(74) *Attorney, Agent, or Firm* — Baker Botts L.L.P.

(57) ABSTRACT

A system including a releasable connector having a housing and a split ring, and a complementary mandrel that is attachable/detachable from the connector, is provided. The mandrel is designed to be received into the housing such that a portion of the mandrel extends out of the housing for connection to a tool. The split ring is disposed in an annular space between the housing and the mandrel when the mandrel is in the housing. The split ring includes at least one set of threads and a detent formed on a radially internal surface, and the mandrel includes complementary threads. The threads on the split ring fully engage the complementary threads on the mandrel when the mandrel is in a particular axial position within the housing. The detent prevents the split ring from collapsing into engagement with the threads on the mandrel until the mandrel is in a desired axial position.

20 Claims, 12 Drawing Sheets

(51) Int. Cl.

| | |
|---|---|
| *E21B 17/042* | (2006.01) |
| *E21B 33/04* | (2006.01) |
| *E21B 34/04* | (2006.01) |

(56) References Cited

U.S. PATENT DOCUMENTS

| | | | | |
|---|---|---|---|---|
| 6,032,736 | A * | 3/2000 | Williams | E21B 47/117<br>166/250.08 |
| 2009/0277645 | A1 | 11/2009 | Pallini et al. | |
| 2012/0012303 | A1* | 1/2012 | Xu | E21B 23/00<br>166/88.2 |
| 2019/0264521 | A1* | 8/2019 | Mageren | E21B 25/10 |

OTHER PUBLICATIONS

International Preliminary Report on Patentability issued in related PCT Application No. PCT/US2019/028700 dated Nov. 5, 2020, 11 pages.

* cited by examiner

RELEASABLE RATCHET LATCH CONNECTOR

CROSS-REFERENCE TO RELATED APPLICATION

The present application is a U.S. National Stage Application of International Application No. PCT/US2019/028700 filed Apr. 23, 2019, which claims priority to U.S. Provisional Application Ser. No. 62/661,706 filed on Apr. 24, 2018, both of which are incorporated herein by reference in their entirety for all purposes.

TECHNICAL FIELD

The present disclosure relates generally to connectors for downhole tools and, more particularly, to a ratchet latch connector with a twist release.

BACKGROUND

Conventional wellhead systems typically include a wellhead housing mounted on the upper end of a subsurface casing string extending into the well bore. A riser and blowout preventer (BOP) are then installed. During the drilling procedure, the BOP is installed above a wellhead housing to provide pressure control as casing is installed, with each casing string having a hanger on its upper end for landing on a shoulder within the wellhead housing. Upon completion of this process, the BOP is replaced by a Christmas tree installed above the wellhead housing, with the tree having a valve to enable the oil or gas to be produced and directed into flow lines for transportation to a desired facility.

At certain points throughout this procedure, one or more testing tools may be lowered through the BOP for connection to wellhead system components. Such testing tools are typically lowered through the BOP rams via a running tool, and placed in a desired location within the wellhead and accompanying equipment. The running tool may disconnect from the testing tool so that the path through the BOP rams is clear, and the BOP rams are then closed for the test to commence. After testing the equipment, the rams may be opened again and the testing tool removed, for example, via a retrieval tool. It is now recognized that a need exists for a more efficient process for setting and later retrieving wellhead testing equipment from a position below the BOP rams.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
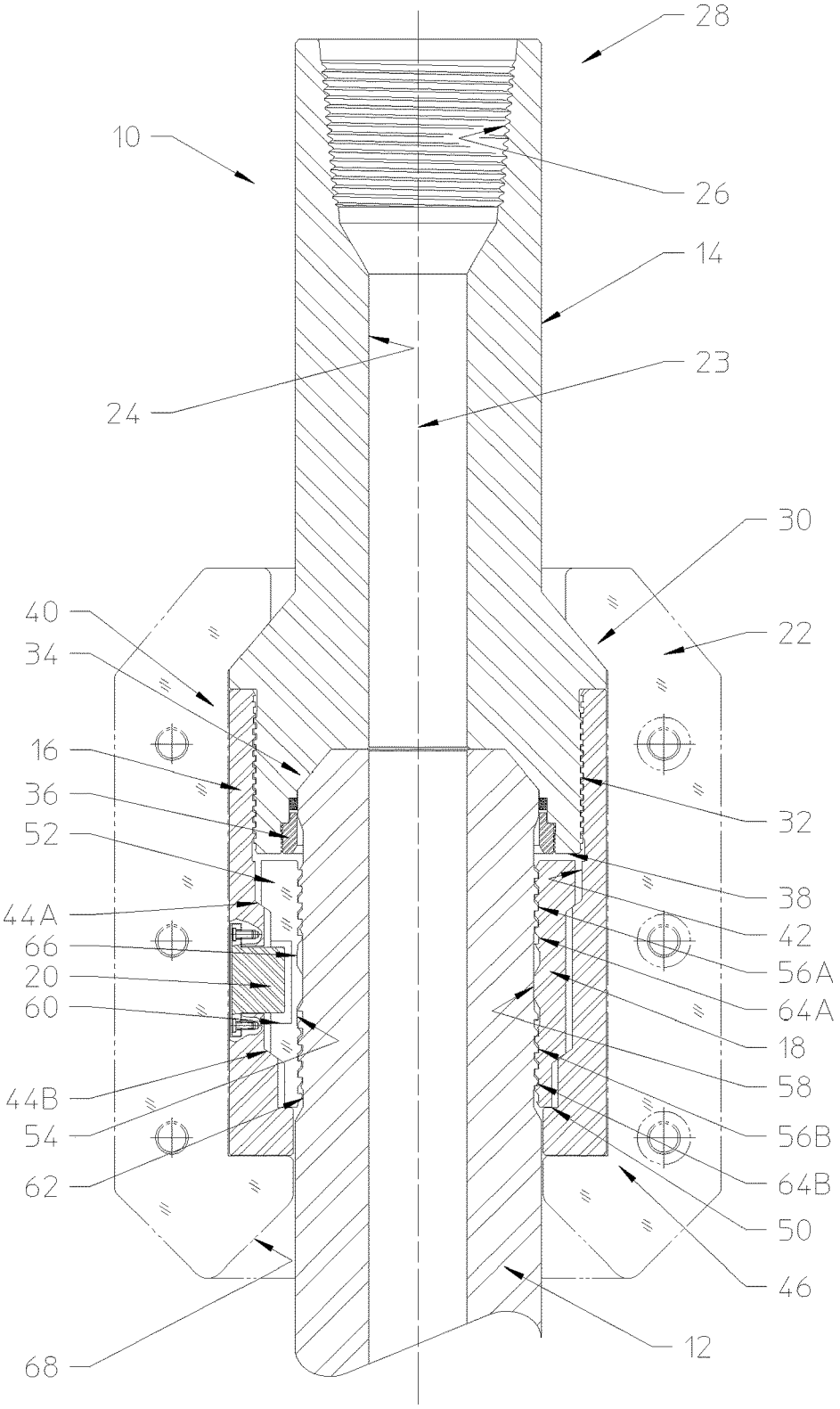
FIG. 1 is a cutaway view of a ratchet latch connector connected to a corresponding mandrel, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to a connector that uses a ratchet latch split ring mechanism to selectively engage and disengage a complementary mandrel. The connector may be used in a well environment to selectively connect/disconnect a tool from a tubular string. The connector may be particularly useful for lowering a test tool through a BOP and into a wellhead below the BOP, disconnecting from the test tool and being pulled upward so that the BOP rams can be closed before the tool performs the test, and reconnecting to and picking up the test tool after the test is complete. The connector features a quick connect/release mechanism that may be controlled from the surface via axial and rotational movement of the tubular string.

The disclosed ratchet latch connector system includes the connector having at least a housing and a split ring, and a complementary mandrel that is selectively attachable/detachable from the connector. The housing may be coupled to a proximal end of a connector sub via a threaded connector. The mandrel is designed to be partially received into the housing such that a portion of the mandrel extends out of the housing for connection to a tool, for example. The split ring is disposed in an annular space between the housing and the mandrel when the mandrel is disposed in the housing. The split ring has some flexibility, which allows the split ring to transition between a radially expanded position and a radially collapsed position. The split ring may include at least one set of threads formed on a radially internal surface thereof, and the mandrel may include at least one set of complementary threads formed on a radially external surface thereof. The threads on the split ring may fully engage the complementary threads on the mandrel when the mandrel is in a particular axial position within the housing.

The split ring also includes a detent formed on the radially internal surface thereof adjacent the threads. The detent may prevent the split ring from collapsing into engagement with the threads on the mandrel until the mandrel is in a proper axial position. While the connector is being lowered onto the mandrel, the split ring is kept in the radially expanded position via the detent interacting with the threads on the mandrel, thereby facilitating a smooth ratcheting of the threads on the split ring over the corresponding threads on the mandrel. The detent may be positioned so as to allow the connector to be disengaged from the mandrel via a simple rotation of the connector relative to the mandrel.

The disclosed ratchet latch connector system may enable the quick and simple disconnection of a tool from a tubular string and later reattachment of the tool to the tubular string in a single trip. The release and reattachment mechanism is purely mechanical and so does not require the use of complicated hydraulic or electrical signaling. The connector provides a reliable and efficient way to land a test tool in a wellhead, operate the test tool after closing the BOP rams, and retrieve the test tool to the surface.

Turning now to the drawings, FIG. 1 is a cross-sectional view of a connector 10 connected to an associated mandrel 12 in accordance with an embodiment of the present disclosure. The connector 10 may include a connector sub 14, a housing 16, a split ring 18, a key 20, and an external housing 22. The connector 10 may include additional components to those that are illustrated in the present figure. In some embodiments, certain illustrated components of the connector 10 may not be present (e.g., external housing 22), or may be combined into a single component (e.g., connector sub 14, housing 16, key 20, and/or external housing 22 in combination).

It should be noted that all descriptions relating to axial and radial directions in the present disclosure are taken with respect to a longitudinal axis 23 of the connector 10 and associated mandrel 12. A radially inward direction is one that faces toward the longitudinal axis 23, and a radially outward direction is one that faces away from the longitudinal axis 23. A distal direction is referring to a first (e.g., upward) axial direction taken along the longitudinal axis 23, while a proximal direction is referring to a second (e.g., downward) axial direction opposite the first axial direction taken along the longitudinal axis 23.

In general, the connector sub 14 is an elongated tubular component having a bore 24 formed therethrough. The connector sub 14 may have a threaded connector 26 at a distal end 28 thereof. The threaded connector 26 allows the connector sub 14 to be connected to a proximal end of a tubular string (not shown). The tubular string may be lowered downhole from a surface location along with the attached connector sub 14, the mandrel 12, and other components of the connector 10.

At a proximal end 30 of the connector sub 14, the connector sub 14 may form a threaded connection 32 with the housing 16, as shown. The threaded connection 32 may be between external threads formed on a radially external surface of the connector sub 14 and internal threads on a radially internal surface of the housing 16. In other embodiments, the arrangement of the connection interface between the connector sub 14 and the housing 16 may be reversed. That is, the threaded connection 32 may instead be between internal threads formed on a radially internal surface of the connector sub 14 and external threads on a radially external surface of the housing 16. In still other embodiments, the connector sub 14 and the housing 16 may be formed as a single integral component.

At the proximal end 30 of the connector sub 14, the bore 24 of the connector sub 14 may widen to a diameter sized to receive a distal end 34 of the mandrel 12. The connector sub 14 may be specifically shaped at the proximal end 30 to match a corresponding shape of the distal end 34 of the mandrel 12 so that the mandrel 12 may be securely received into position within the connector 10 with the distal end 34 resting against the connector sub 14. The connector sub 14 may be equipped with an annular seal 36 disposed on a radially internal surface thereof at the proximal end 30 so as to seal the annular space between the connector sub 14 and the mandrel 12. An annular portion of the proximal end 30 of the connector sub 14 may extend axially downward into an annular space between the housing 16 and the mandrel 12 (when the mandrel 12 is positioned in the housing 16) to provide a stop 38 or shoulder for an upper end of the split ring 18.

The housing 16 may have a generally tubular shape, as shown. A distal end 40 of the housing 16 may include threads that form the threaded connection 32 with the connector sub 14 as described above. Below this threaded connection 32, the housing 16 may include a stepped profile formed on a radially internal surface 42 of the housing 16. The stepped profile of the housing 16 in general matches a radially external profile of the split ring 18 disposed in the housing 16.

The stepped profile may include a number of steps 44 that progress the housing 16 from a wider inner diameter at the distal end 40 of the housing to a less wide inner diameter at a proximal end 46 of the housing 16. For example, in the illustrated embodiment, the housing 16 includes two steps 44A and 44B formed along its internal surface 42. However, other embodiments of the housing 16 may include one, three, four, or more steps 44 formed at this surface. The steps 44A and 44B may help to maintain the position of the split ring 18 within the housing 16. The steps 44A and 44B moving from one inner diameter of the housing 16 to the next may be slanted with respect to a plane perpendicular to the longitudinal axis 23. This angle forces the split ring 18 in the radially inward direction when it is engaged with the mandrel 12 to prevent inadvertent disengagement of the split ring 18 when the connector is under tension.

At a final portion of the stepped profile, the housing 16 may include a sharp stepped portion at its proximal end 46. The stepped portion may generally function as a stop shoulder 50 to keep the split ring 18 positioned within the housing 16 at all times.

The split ring 18 is a ring that is not continuous around its entire circumference. The split ring 18 includes an open slot (split) formed at a particular circumferential position of the split ring 18. The slot extends in an axial direction through the entire split ring 18 at this circumferential location. FIG. 1 illustrates a cavity 52 where this split occurs. This structure of the split ring 18 allows the split ring 18 to transition between a radially expanded position (e.g., shown in FIGS. 2 and 4) and a radially collapsed position (e.g., shown in FIGS. 1 and 3). The split ring 18 is generally biased toward the radially collapsed position. Upon contact of a wider diameter portion of the mandrel 12 with a radially internal surface 54 of the split ring 18, however, the split ring 18 is forced to expand radially outward into the expanded position. The steps 44 of the housing 16 may guide the split ring 18 to move slightly in the distal (i.e., upward) direction as it is radially expanded, or to move slightly in the proximal (i.e., downward) direction as it is radially collapsed.

As mentioned above, the split ring 18 includes at least one set of threads 56 formed on the radially internal surface 54.

In the illustrated embodiment, for example, the split ring 18 includes two sets of threads 56A and 56B. However, it should be noted that additional or fewer sets of threads 56 may be utilized in other embodiments. The individual threads making up each set 56 may be angled as they extend radially inward from the rest of the split ring 18. Specifically, the threads may each be slanted in the distal (i.e., upward) direction as they extend radially inward. This allows the threads to slide over corresponding threads of the mandrel 12 in a ratcheting operation until the mandrel 12 is at a desired location within the housing 16, at which point the threads 56 can lock the mandrel 12 in place. The term "ratchet" or "ratcheting" herein refers to an action where a threaded component (i.e., split ring 18) is able to slide over a complementary threaded component (i.e., mandrel 12) when moving relative to the complementary component in one axial direction (e.g., proximal direction), but not in the opposite direction (e.g., distal direction).

The two sets of threads 56A and 56B may be interrupted by a detent 58 formed on the radially internal surface 54 of the split ring 18. The detent 58, as shown, extends in a radially inward direction. The detent 58 may extend in this radial direction about the same distance as any one of the threads (i.e., from root to crest) in the at least one set of threads 56. However, the detent 58 extends a length in the axial direction that is multiple times the pitch of any one of the threads in the at least one set of threads 56. As such, the detent 58 cannot be received into any of the threads on the mandrel 12 as the split ring 18 moves relative to the mandrel 12. In the illustrated embodiment, the detent 58 is located axially between the two sets of threads 56A and 56B. However, in other embodiments, the detent 58 may be located adjacent a single set of threads, or multiple detents may be located axially between multiple sets 56 of threads.

The threads in each set 56 may progress in an axial direction as they extend around the inner circumference of the split ring 18. That way, as the connector 10 is rotated relative to the mandrel 12, the split ring 18 may travel in an axial direction with respect to the mandrel 12. Once the detent 58 reaches a point of engagement with one of the corresponding threads on the mandrel 12, the detent 58 may act as a cam to expand the split ring 18 into the radially expanded position and out of engaging contact with the mandrel 12.

The detent 58 may extend around the entire inner circumference of the split ring 18, and the detent 58 may be located at the same axial position as it extends around the split ring 18. In other embodiments, the detent 58 may progress in an axial direction as it extends around the inner circumference of the split ring 18.

The key 20 may be coupled to the housing and extend in a radially inward direction into the cavity 52 defined by the axial slot in the split ring 18. The key 20 prevents the split ring 18 from rotating relative to the housing 16. In some embodiments, a portion 60 of the split ring 18 on one or both sides of the open slot in the ring may be cut out to fit around the key 20 as well. This cutout portion 60 of the split ring 18 may be slightly longer in the axial dimension than the key 20, thereby allowing the split ring 18 to move axially by a certain amount relative to the housing 16, such as when the split ring 18 is expanded or collapsed.

The mandrel 12, as shown, features a specific profile formed on a radially external surface 62 thereof. This profile is generally complementary to the profile formed on the internal surface 54 of the split ring 18. The mandrel 12 includes at least one set of external threads 64 formed on the external surface 62, and the at least one set of external threads 64 are positioned to interact with the corresponding internal sets of threads 56 on the split ring 18. In the illustrated embodiment, for example, the mandrel 12 includes two sets of threads 64A and 64B. However, it should be noted that additional or fewer sets of threads 64 may be utilized in other embodiments.

The individual threads making up each set 64 may be angled as they extend radially outward from the rest of the mandrel 12 (similar to those threads on the split ring 18). Specifically, the threads may each be slanted in the proximal (i.e., downward) direction as they extend radially outward, so as to interconnect with the threads on the split ring 18 when the split ring 18 is collapsed into engagement with the mandrel 12. The angle of the threads on the mandrel 12 allow the split ring 18 to ratchet over the threads on the mandrel 12 until the mandrel 12 is at a desired location within the housing 16, at which point the threads 56 on the split ring can lock into engagement with the threads 64 on the mandrel 12 to hold the mandrel 12 in place.

The two sets of threads 64A and 64B may be interrupted by an indentation 66 formed on the radially external surface of the mandrel 12. The indentation 66, as shown, generally extends in a radially inward direction. The indentation 66 may extend in this direction about the same distance as any one of the threads (i.e., from root to crest) in the at least one set of threads 64. However, the indentation 66 has a length in the axial direction that is multiple times the pitch of any one of the threads in the at least one set of threads 64. That way, the indentation 66 is able to capture the corresponding detent 58 of the split ring 18 when the split ring 18 is in the axial position relative to the mandrel 12 where the split ring 18 collapses into engagement with the mandrel 12. In the illustrated embodiment, the indentation 66 is located axially between the two sets of threads 64A and 64B. However, in other embodiments, the indentation 66 may be located adjacent a single set of threads, or multiple indentations may be located axially between multiple sets of threads. In still other embodiments, the mandrel 12 may not have an indentation at all, but may instead feature an elongated flat portion of the external surface 62 that functions to receive the detent 58 of the split ring 18.

The external housing 22 may be included in the connector 10 to provide a protective housing for the internal components of the connector 10 and the mandrel 12. The external housing 22, as shown, may be disposed around the proximal end 30 of the connector sub 14, the entire housing 16, split ring 18, and key 20, and the distal end 34 of the mandrel 12. The external housing may include two or more pieces that are bolted together to form the protective housing. The external housing 22 has a bore formed therethrough. As illustrated, the external housing 22 includes an opening at its proximal end, and the opening may feature sloped walls 68 (i.e., angled relative to the longitudinal axis 23). The sloped walls 68 at the opening in the proximal end of the external housing 22 may help to guide the mandrel 12 into the housing 16 (and split ring 18) as the connector 10 is moved axially toward the mandrel 12 for receiving and connecting to the mandrel 12.

Having described the structure of the disclosed connector 10 and associated mandrel 12, a detailed description of a method for operating the connector 10 to selectively connect to and release the mandrel 12 will now be provided. FIG. 1 illustrates the connector 10 being connected to and fully engaged with the mandrel 12 via the collapsed split ring 18. The split ring 18 is held in place within the housing 16 via the stop shoulder 50 and the steps 44A and 44B of the housing 16. The split ring 18 is in the collapsed configuration such that the at least one set of threads 56A and 56B of the split ring 18 fully engage the at least one set of threads 64A and 64B of the mandrel 12. The angle of the threads on both components ensures that the force due to gravity on the mandrel (and any connected downhole tools) is transmitted through the threads to the split ring 18, the housing 16, and the connector sub 14. Thus, the connector 10 is able to hold the weight of the mandrel 12 and other connected components. It is in this connected configuration that the connector 10 and attached mandrel 12 may be initially lowered toward or through a well.

Figure 2:
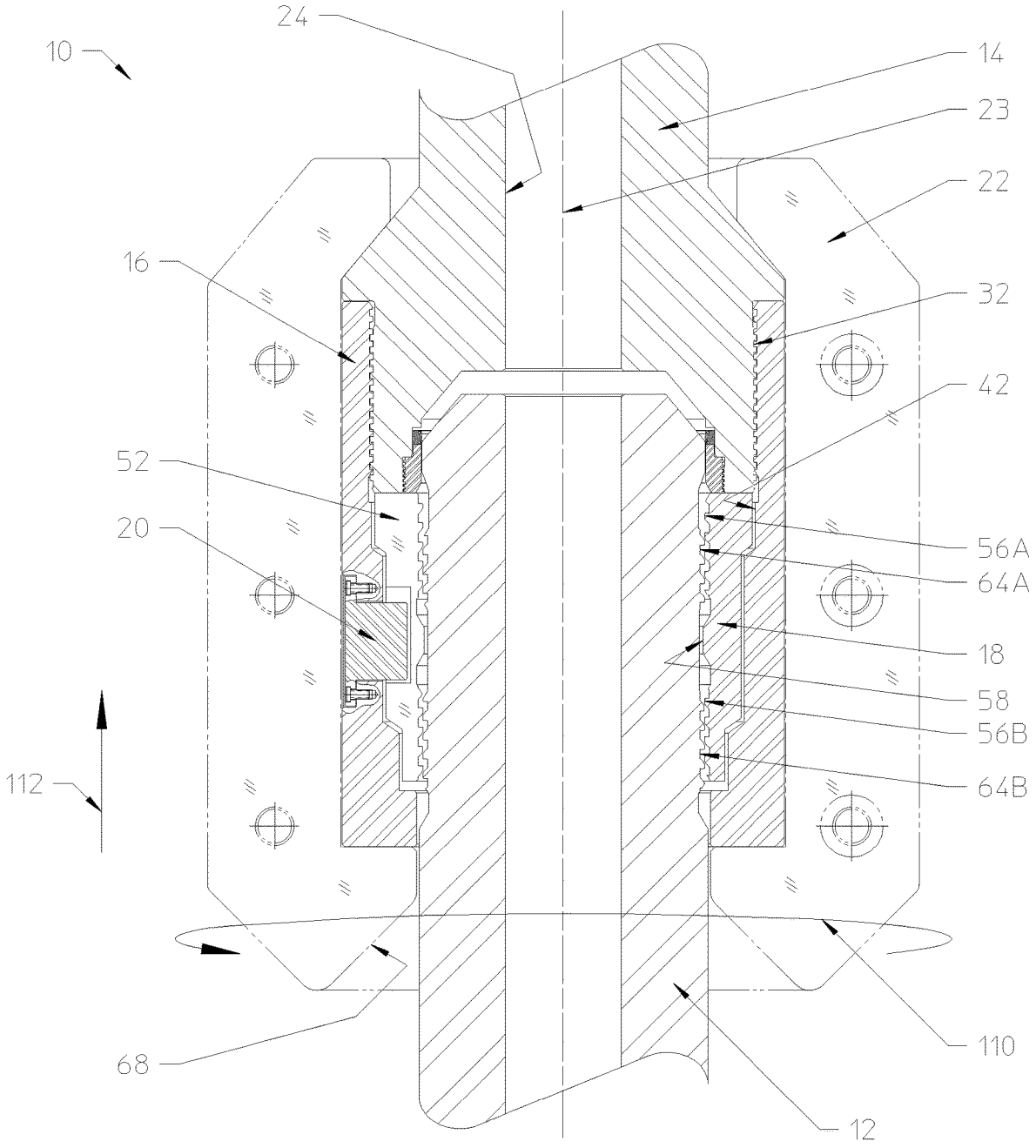
FIG. 2 is a cutaway view of the ratchet latch connector of FIG. 1 being disconnected from the mandrel, in accordance with an embodiment of the present disclosure.

At some point, the mandrel 12 may be lowered to a desired position for being released from the connector 10, such as a location at which a tool coupled to the mandrel 12 is landed (e.g., in a wellhead). To release the mandrel 12 from the connector 10, an operator may rotate the uphole tubular string that is coupled to the connector sub 14, thereby rotating the entire connector 10. This is shown in FIG. 2, where an arrow 110 indicates the rotation (e.g., right hand turn) of the connector 10 relative to the mandrel 12. The mandrel 12 may remain in place due to a tool at its lower end being landed and secured at a desired location. As such, the connector sub 14, housing 16, split ring 18, key 20, and/or external housing 22 may rotate relative to the mandrel 12.

As a result of this rotation, the connector 10 may begin to move axially upward (arrow 112) relative to the mandrel 12, as the rotation causes the set(s) of threads 56 on the split ring 18 to traverse the corresponding set(s) of threads 64 on the mandrel 12. At some point in traveling up the threads 64 on the mandrel 12, the split ring 18 reaches an axial position relative to the mandrel 12 where the detent 58 abuts a lower surface of one of the mandrel threads. Further rotation of the connector 10 and resulting axial movement of the split ring 18 relative to the mandrel 12 causes the detent 58 to act as a cam forcing the split ring 18 from its collapsed configuration to its expanded configuration, as shown in FIG. 2. At this point, the split ring 18 is disengaged from the threaded profile of the mandrel 12, and the connector 10 is able to be axially lifted off the mandrel 12. In the expanded configuration, the threads 56 and detent 58 of the split ring 18 are able to slide over the threads 64 on the mandrel 12.

Figure 3:
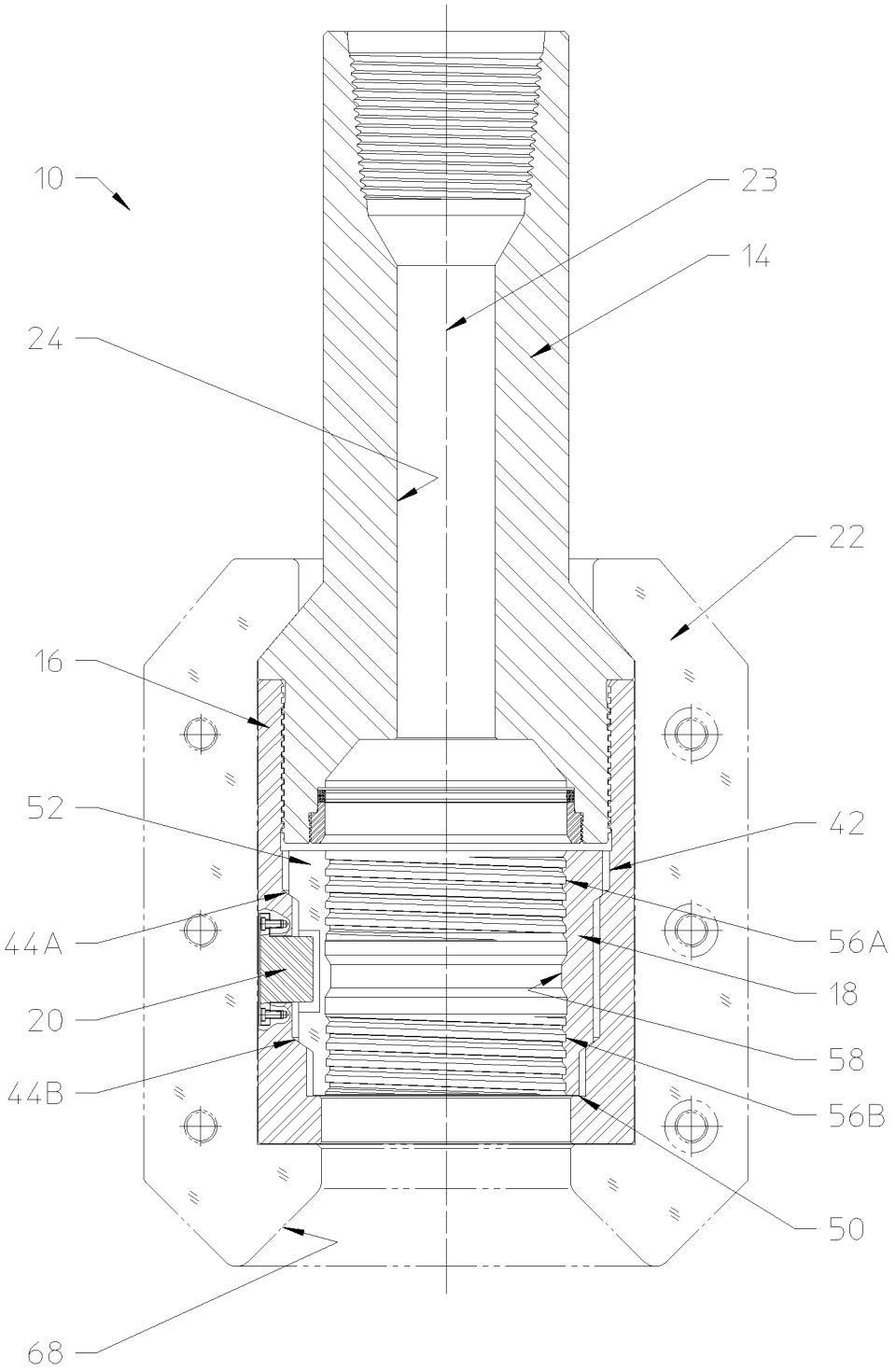
FIG. 3 is a cutaway view of the ratchet latch connector of FIG. 1 fully removed from the mandrel, in accordance with an embodiment of the present disclosure.

Further upward movement of the connector 10 disconnects the connector 10 entirely from the mandrel 12 such that the mandrel 12 remains at the location at which it was landed and the connector 10 is retrieved to an upward location, as shown in FIG. 3. This figure shows that once the connector 12 has been removed from the mandrel 12, the split ring 18 is biased back to its initial collapsed position within the housing 16. The housing 16 maintains the split ring 18 in place via the stop shoulder 50 and the steps 44A and 44B.

Figure 4:
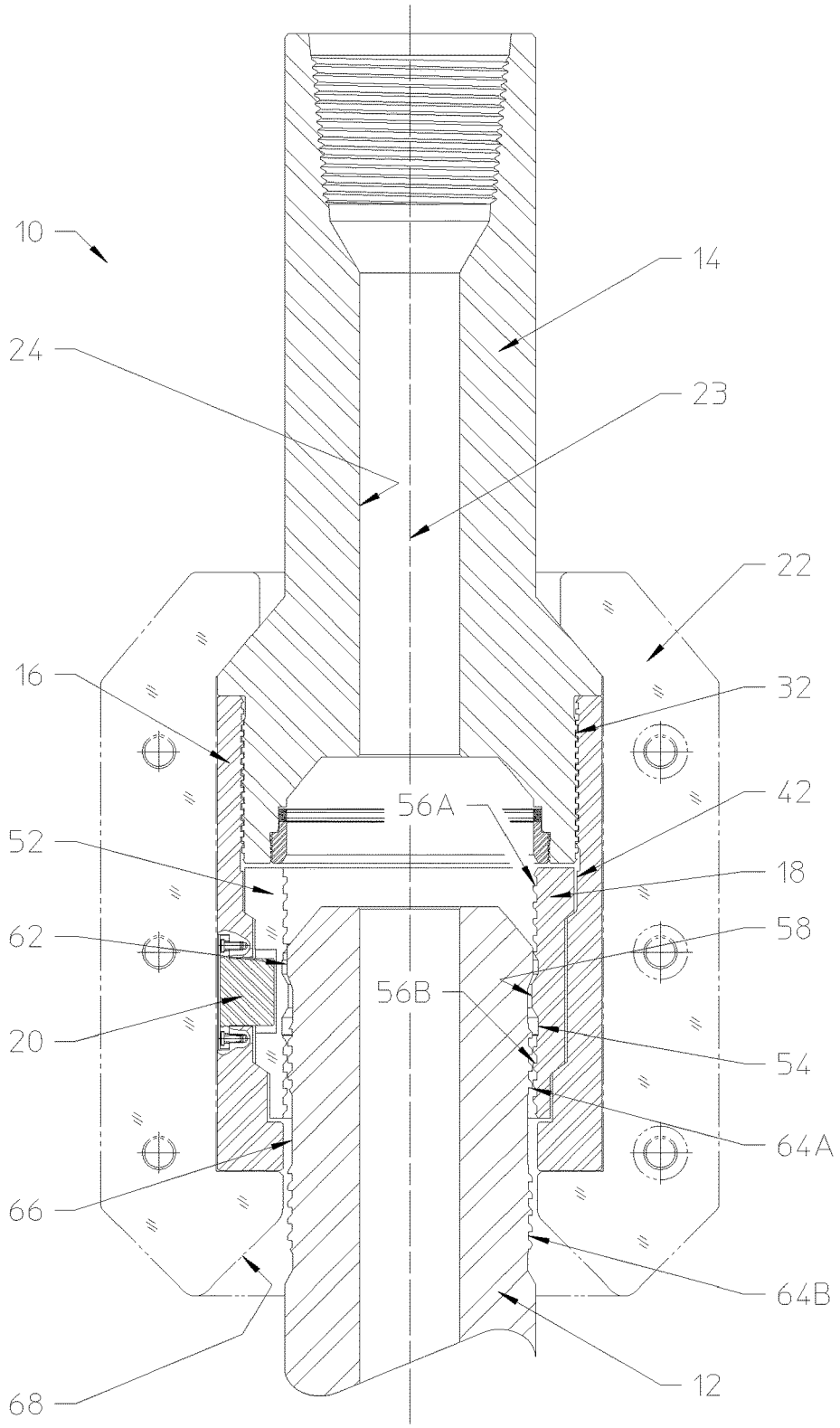
FIG. 4 is a cutaway view of the ratchet latch connector of FIG. 1 being reconnected to the mandrel, in accordance with an embodiment of the present disclosure.

To reattach the connector 10 to the mandrel 12, the connector 10 may be lowered back down over the distal end of the mandrel 12, as shown in FIG. 4. The sloped walls 68 at the proximal end of the external housing 22 may guide the distal end of the mandrel 12 into the housing 16 and split ring 18. As the mandrel 12 enters the split ring 18, the radially external surface 62 of the mandrel 12 comes into contact with the radially internal surface 54 of the split ring 18, thereby forcing the split ring 18 from the collapsed configuration to its expanded configuration. In this expanded configuration, the internal threads 56 of the split ring 18 are able to ratchet downward over the threads 64 of the mandrel 12 as the connector 10 is moved axially downward with respect to the mandrel 12. The internal profile of the split ring 18 with the detent 58 prevents the threads 56 of the split ring 18 from engaging the threads 64 on the mandrel 12 until the split ring 18 reaches an axial position relative to the mandrel 12 where the detent 58 is received in the indentation 66. When the detent 58 reaches the indentation 66 and the corresponding threads of the split ring 18 and mandrel 12 are in alignment, the split ring 18 collapses into a secure engagement with the mandrel 12 (seen in FIG. 1). As a result, the connector 10 is fully connected in a load bearing manner to the mandrel 12. The connector sub 14 may then be raised upward to retrieve the connected mandrel 12 (and any attached tools) to the surface.

Examples of the types of tools that may be lowered downhole, disconnected from, reconnected to, and retrieved to the surface via the disclosed connector 10 are provided and illustrated in FIGS. 5A, 5B, 6A, 6B, 7A, 7B, 8A, and 8B.

FIGS. 5A, 5B, 6A, 6B, 7A, 7B, 8A, and 8B illustrate different systems that may utilize the connector 10 and the mandrel 12 described above. The mandrel 12 in these figures may be coupled to a BOP test tool 210 for positioning within a wellhead 212. As shown in FIGS. 5A, 5B, 6A, and 6B, the mandrel 12 may be coupled to the BOP test tool 210 via a tubular 214 connected between the mandrel 12 and the test tool 210. In other embodiments, as shown in FIGS. 7A, 7B, 8A, and 8B, the mandrel 12 may be directly coupled to the BOP test tool 210.

Figure 5A:
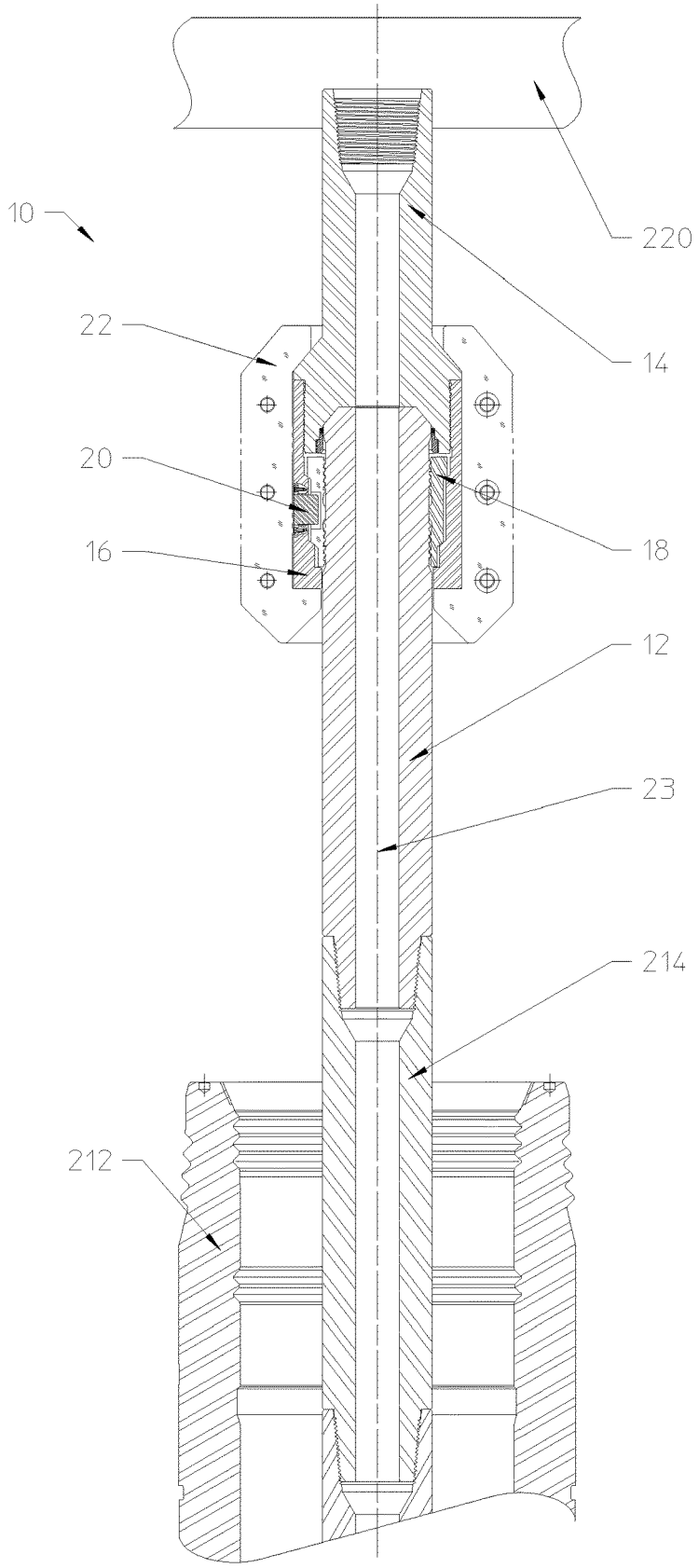
FIGS. 5A and 5B are a cutaway view of the ratchet latch connector of FIG. 1 in engagement with a mandrel coupled to a BOP test tool, in accordance with an embodiment of the present disclosure.
Figure 5B:
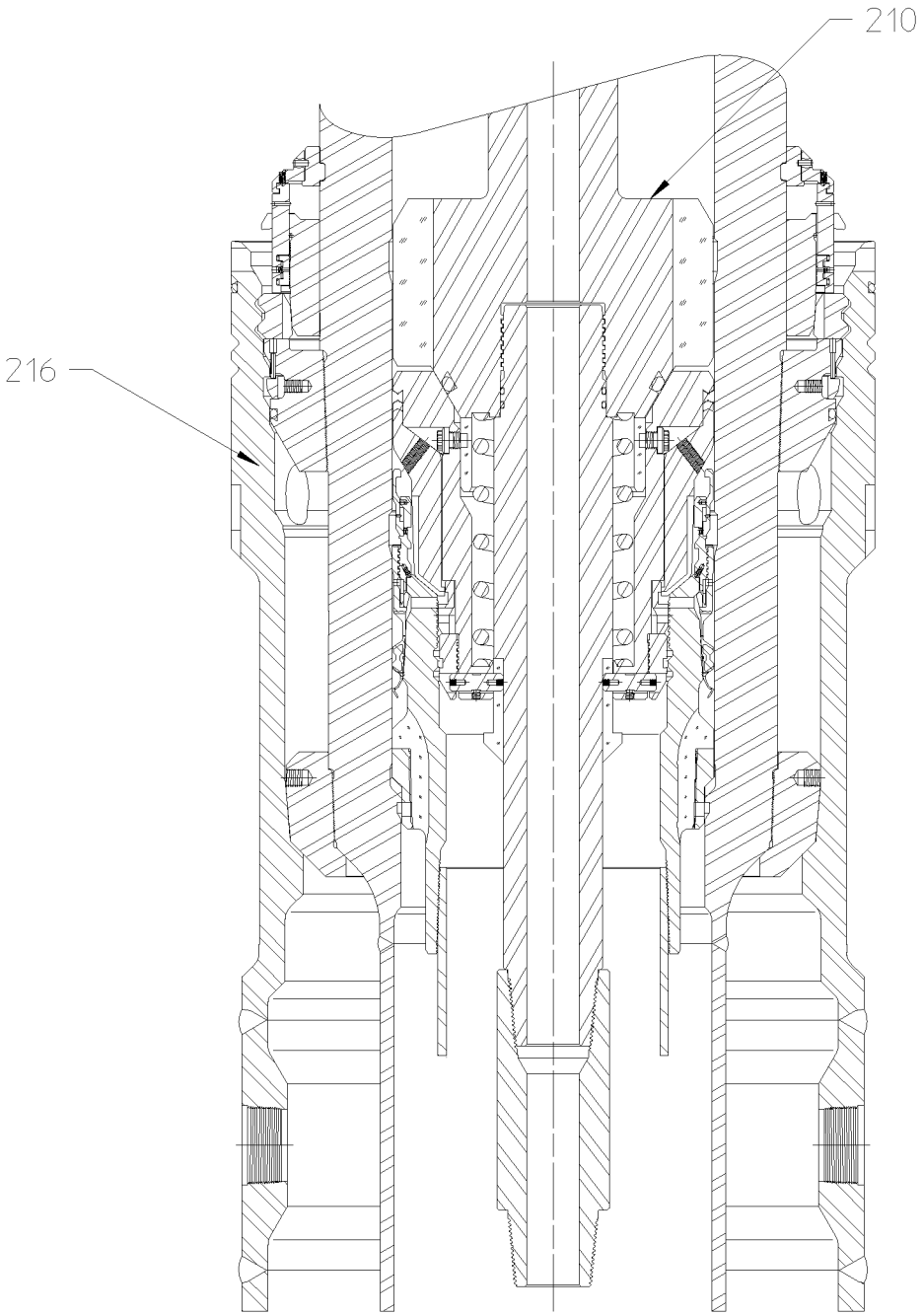

In FIGS. 5A and 5B, the test tool 210 may be designed to test a wellhead 212. As shown, the wellhead 212 is disposed within and extends downward into a conductor housing 216. The test tool 210 may be operated to ensure that the wellhead 212 is securely positioned and sealed within the conductor housing 216.

Figure 6A:
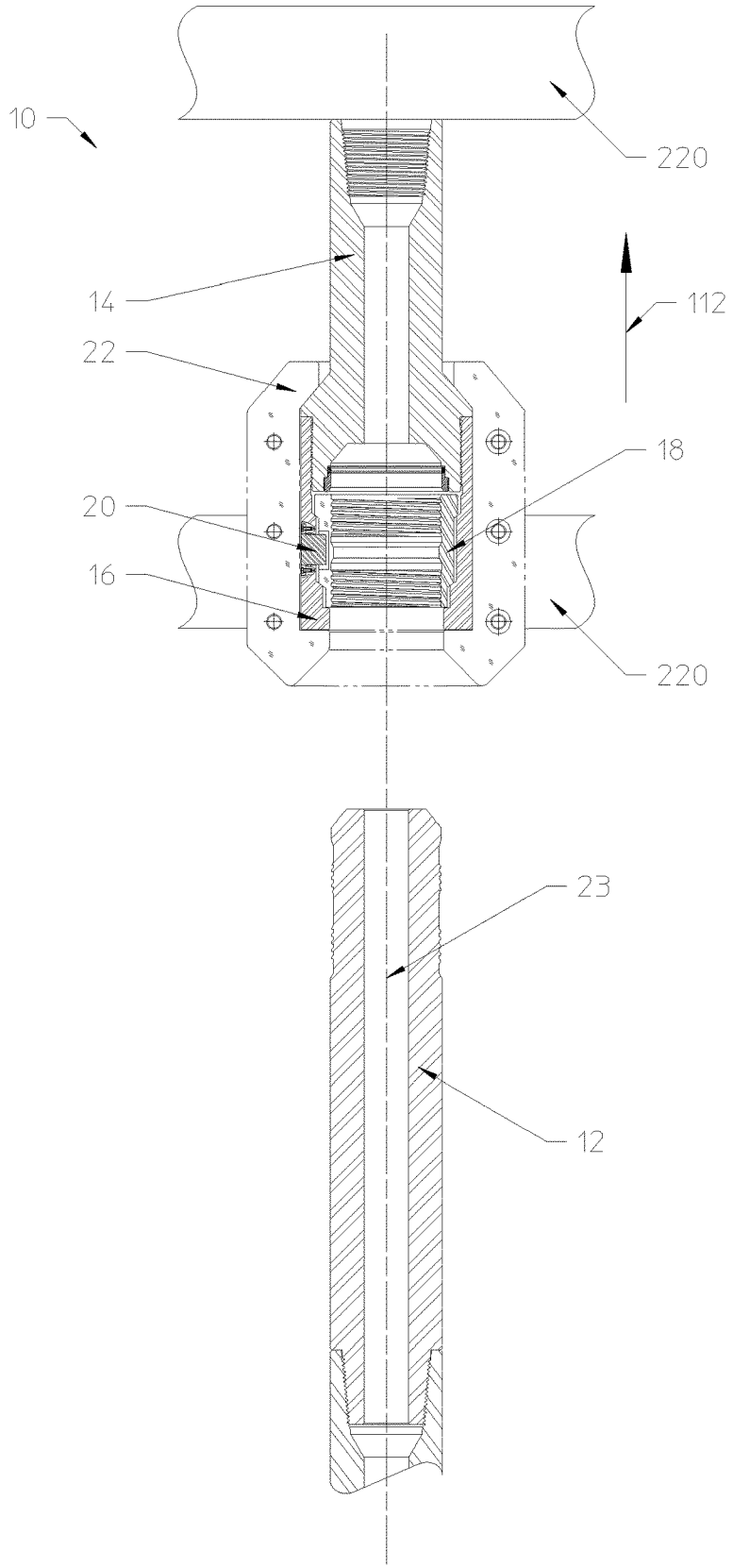
FIGS. 6A and 6B are a cutaway view of the ratchet latch connector of FIG. 1 being removed from a mandrel coupled to a BOP test tool, in accordance with an embodiment of the present disclosure.
Figure 6B:
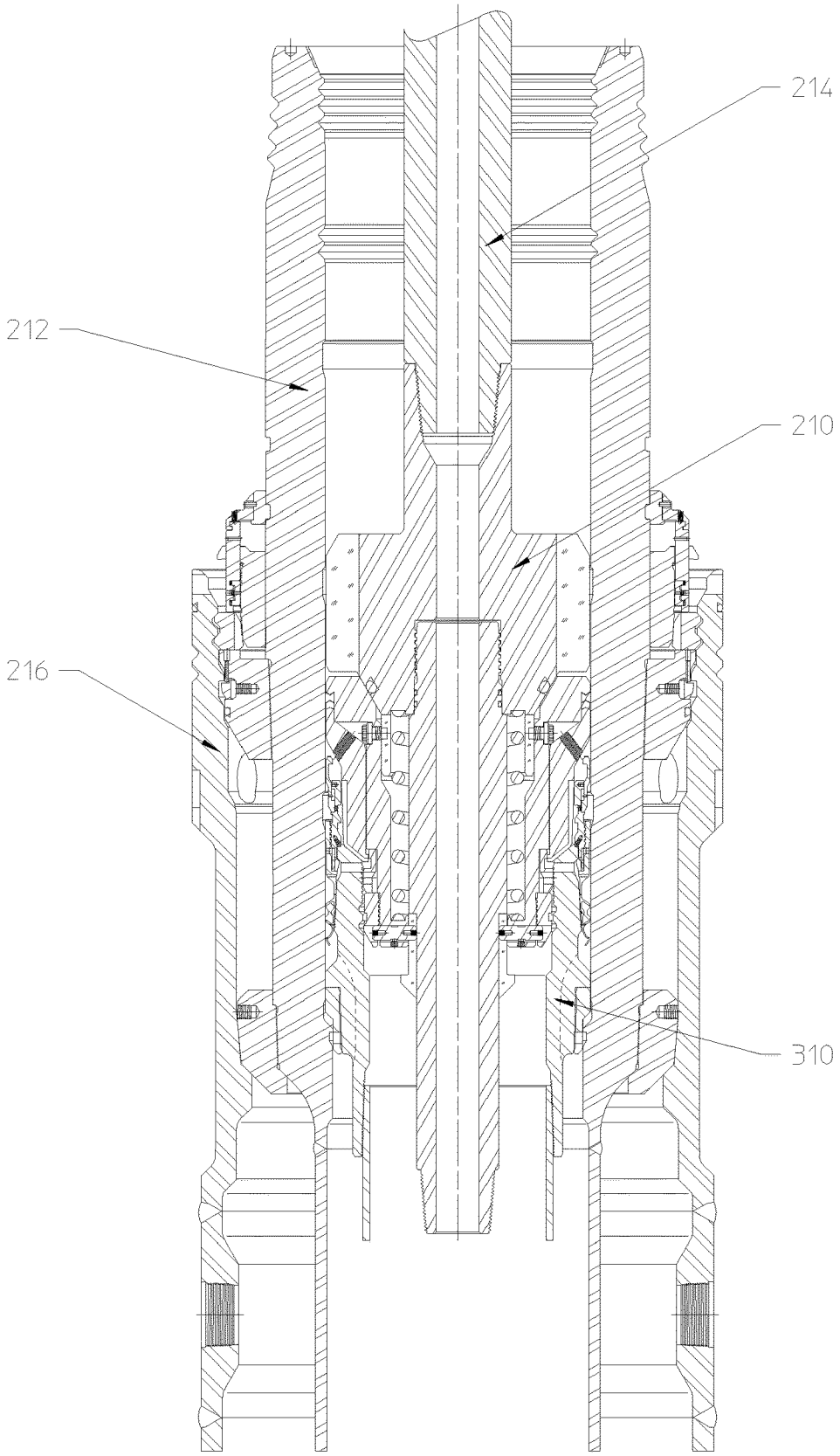

In FIGS. 6A and 6B, the test tool 210 may be designed to test a casing or tubing hanger 310 (e.g., a 14" hanger) located in the wellhead 212. As shown, the wellhead 212 is disposed within and extends downward into a conductor housing 216, and the hanger 310 is disposed within and extends downward through (and beyond) the wellhead 212. The test tool 210 may be operated to ensure that the hanger 310 is securely positioned and sealed within the wellhead 212.

Figure 7A:
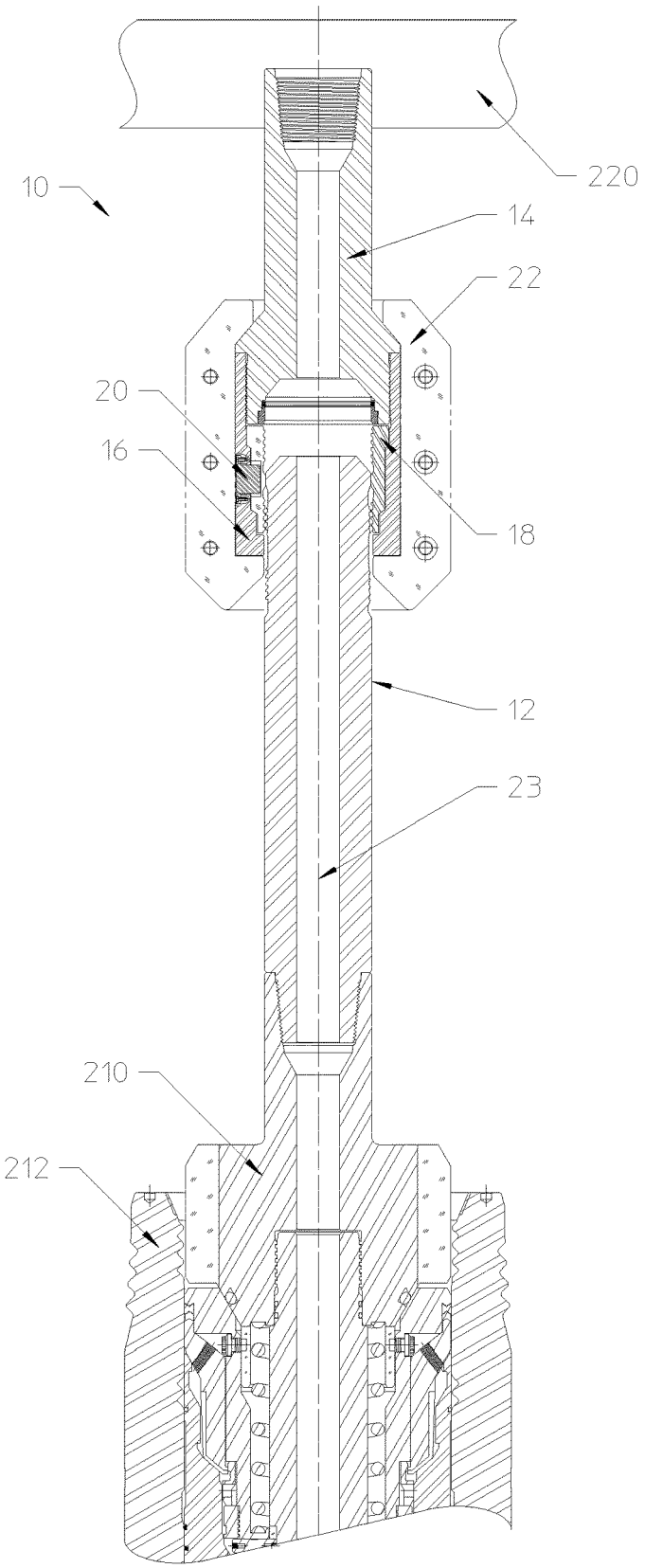
FIGS. 7A and 7B are a cutaway view of the ratchet latch connector of FIG. 1 being reconnected to a mandrel coupled to a BOP test tool, in accordance with an embodiment of the present disclosure.
Figure 7B:
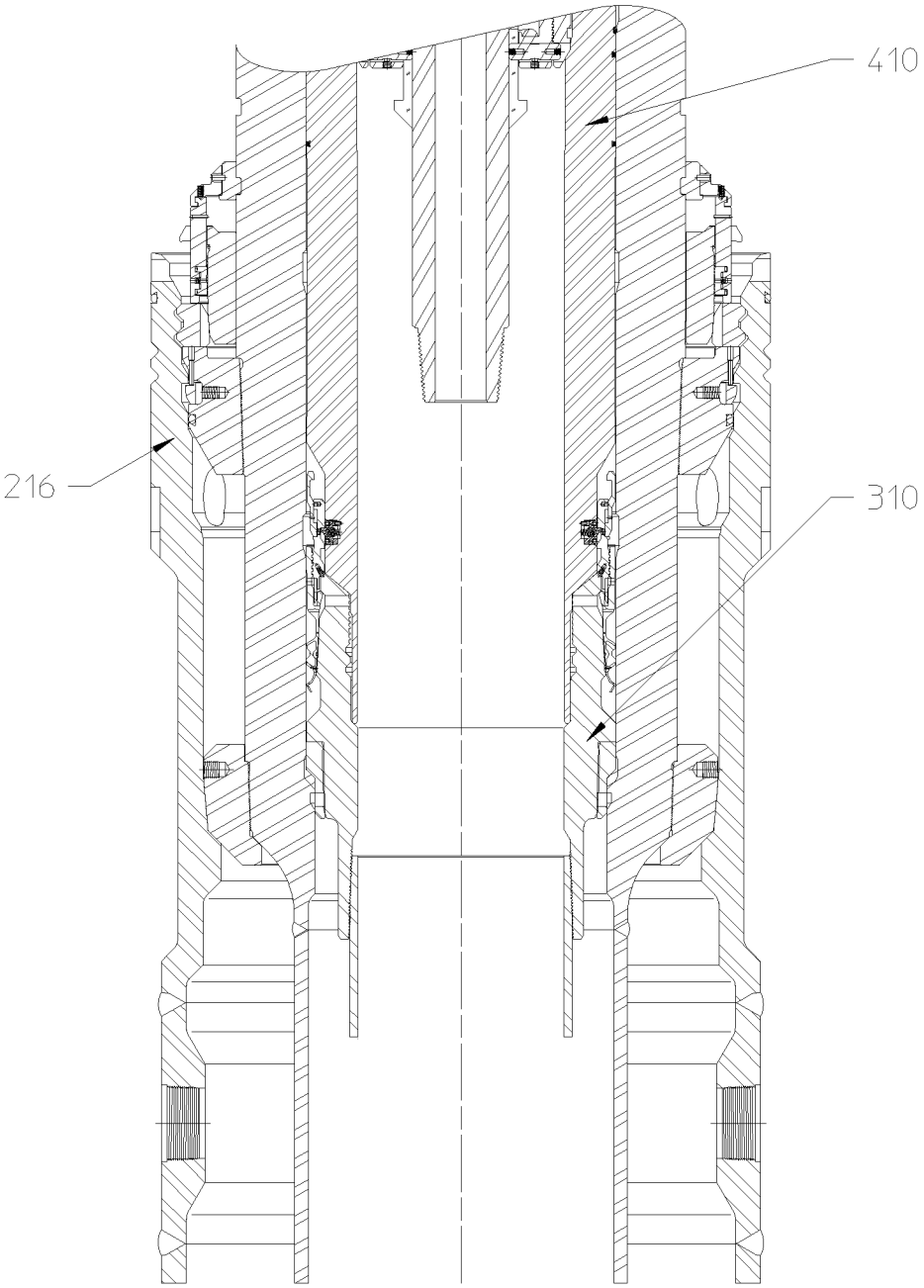

In FIGS. 7A and 7B, the test tool 210 may be designed to test a wear busing 410 (e.g., a 13⅜" wear bushing) located in the wellhead 212. As shown, the wellhead 212 is disposed within and extends downward into a conductor housing 216, a hanger 310 is disposed within and extends downward through (and beyond) the wellhead 212, and the wear bushing 410 is disposed within the wellhead 212 and supported by the hanger 310. The test tool 210 may be operated to ensure that the wear bushing 410 is securely positioned and sealed within the wellhead 212.

Figure 8A:
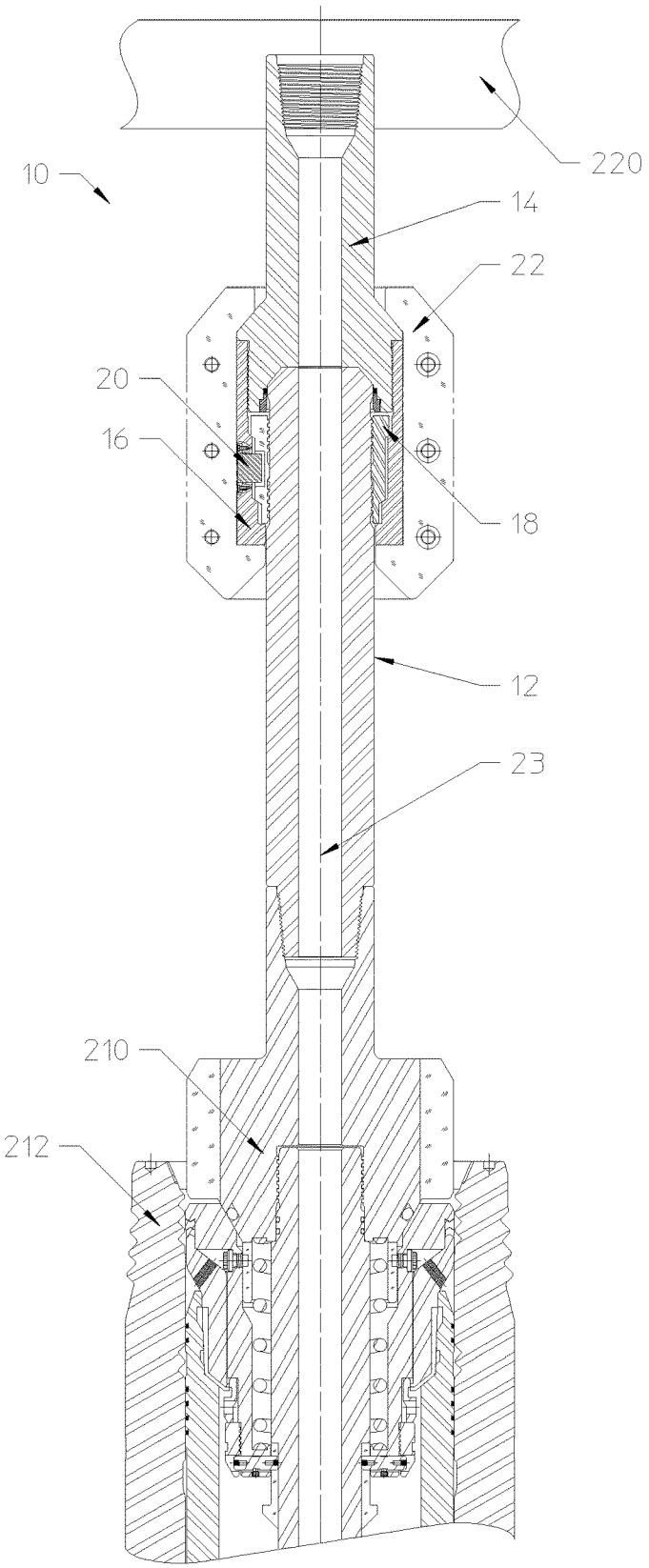
FIGS. 8A and 8B are a cutaway view of the ratchet latch connector of FIG. 1 in engagement with a mandrel coupled to a BOP test tool, in accordance with an embodiment of the present disclosure.
Figure 8B:
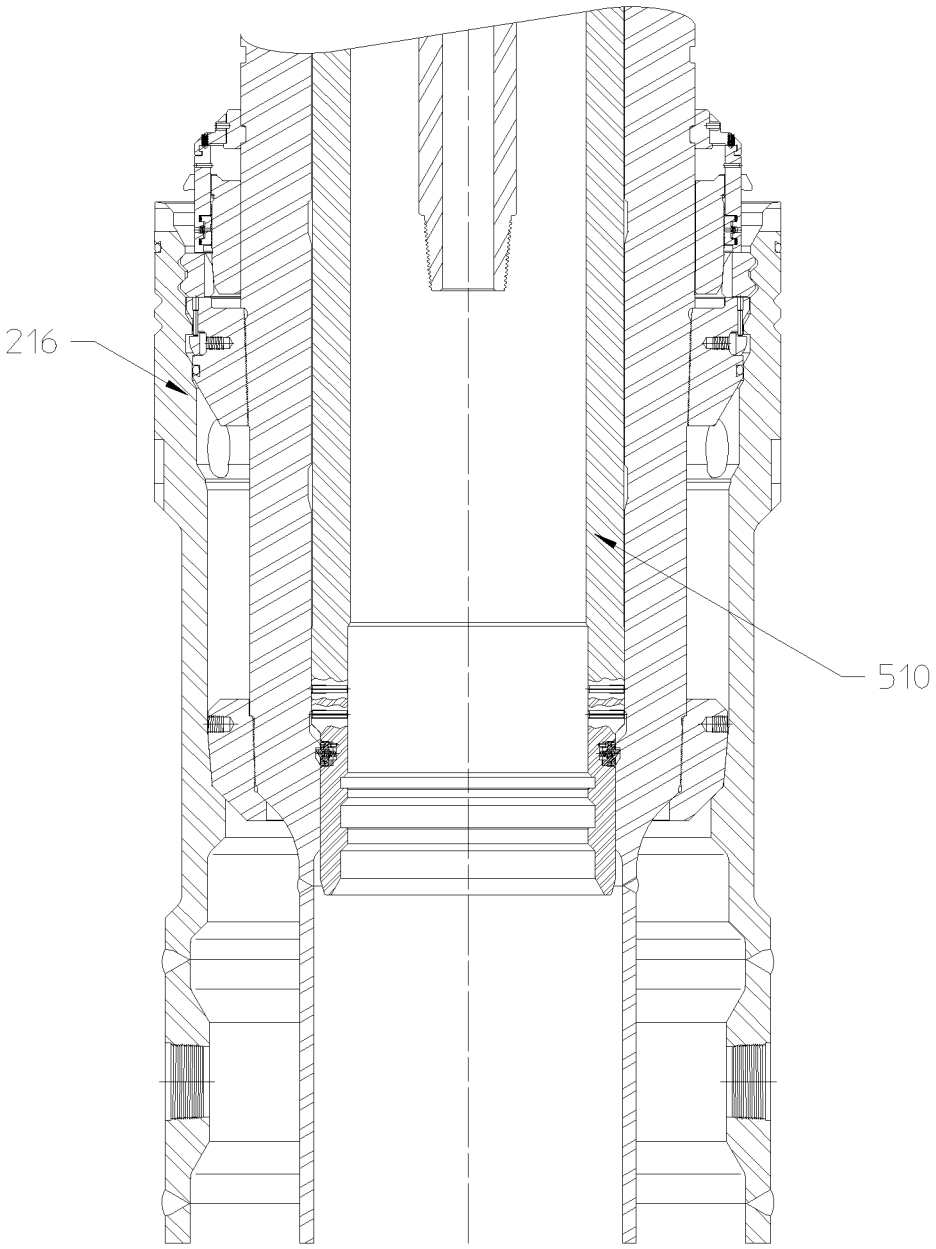

In FIGS. 8A and 8B, the test tool 210 may be designed to test a wear sleeve 510 (e.g., a 18/16" wear sleeve) located in the wellhead 212. As shown, the wellhead 212 is disposed within and extends downward into a conductor housing 216, and the wear sleeve 510 is disposed within the wellhead 212. The test tool 210 may be operated to ensure that the wear sleeve 510 is securely positioned and sealed within the wellhead 212.

To perform the desired testing in any one of these embodiments of FIGS. 5A, 5B, 6A, 6B, 7A, 7B, 8A, and 8B, it may be desirable for a series of BOP rams 220 located uphole of the wellhead 212 to be closed prior to performing the test. As such, the connector 10 and above tubing may lower the mandrel 12 through the open rams 220 to a position where the attached test tool 210 is landed in the wellhead 212 (FIGS. 5A-5B). The connector 10 may then be disconnected from the mandrel 12, via rotation as described above, and withdrawn upward (FIG. 6A—arrow 112) to a position above the BOP rams 220 so that the rams 220 can be closed and the desired test performed in the wellhead 212. Once the test is finished, the rams 220 may be reopened, the connector 10 lowered back down onto the mandrel 12 (FIG. 7A) until it is fully connected to the mandrel 12 (FIG. 8A), and the mandrel 12 and connected test tool 210 retrieved to the surface.

Although the present disclosure and its advantages have been described in detail, it should be understood that various changes, substitutions and alterations can be made herein without departing from the spirit and scope of the disclosure as defined by the following claims.

What is claimed is:

1. A system, comprising:

a tubular housing;

a mandrel removably disposed in the housing, wherein the mandrel comprises at least one set of threads formed on a radially external surface thereof;

a split ring disposed within the housing and biased in a radially inward direction, wherein the split ring comprises:

at least one set of threads formed on a radially internal surface of the split ring, wherein the at least one set of threads on the split ring is complementary to the at least one set of threads of the mandrel; and a detent formed on the radially internal surface of the split ring adjacent the at least one set of threads of the split ring, wherein the detent has a length in an axial direction greater than a pitch of any one thread in the at least one set of threads on the split ring.

2. The system of claim 1, wherein the split ring is disposed within an annular space between the mandrel and the housing when the mandrel is disposed in the housing.

3. The system of claim 1, wherein the split ring comprises a first set of threads and a second set of threads formed on the radially internal surface of the split ring, wherein the detent is located axially between the first set of threads and the second set of threads.

4. The system of claim 1, wherein the at least one set of threads of the split ring comprises threads having an angled profile.

5. The system of claim 1, wherein the detent extends around the entire internal surface of the split ring, and wherein the detent is located at the same axial position as it extends around the entire split ring.

6. The system of claim 1, further comprising a key coupled to the housing, wherein the key extends into a cavity formed at a circumferential position where the split ring is split, wherein the key prevents the split ring from rotating relative to the housing.

7. The system of claim 1, wherein the detent on the split ring acts as a cam to expand the split ring from a collapsed position to an expanded position upon engagement with a thread of the at least one set of threads of the mandrel while the split ring is rotated relative to the mandrel.

8. The system of claim 1, wherein the at least one set of threads on the split ring is configured to engage the at least one set of threads of the mandrel to facilitate load transfer between the housing and the mandrel.

9. The system of claim 1, further comprising a BOP test tool coupled to a proximal end of the mandrel.

10. The system of claim 1, further comprising a connector sub comprising a distal end, a proximal end opposite the distal end, and a bore formed therethrough, wherein the connector sub further comprises a threaded connector at the distal end, and wherein the housing is coupled to the proximal end of the connector sub.

11. The system of claim 10, further comprising an outer housing disposed externally around the housing and around a portion of the connector sub.

12. The system of claim 11, wherein the outer housing comprises an opening at a bottom portion thereof, the opening comprising sloped walls to guide the mandrel into the housing.

13. A method, comprising:

receiving a mandrel into an opening at a proximal end of a connector, the connector comprising a tubular housing and a split ring disposed in the housing, wherein the split ring is biased in a radially inward direction;

expanding the split ring radially outward as the mandrel is received further into the connector, wherein the split ring is in a radially expanded position within the housing such that at least one set of threads formed on a radially internal surface of the split ring floats over a complementary at least one set of threads on the mandrel; and collapsing the split ring to engage the at least one set of threads on the mandrel upon the mandrel reaching a position where a detent formed on the radially internal surface of the split ring is received into a corresponding slot on the mandrel.

14. The method of claim 13, further comprising rotating the connector with respect to the mandrel to disengage the split ring from the mandrel.

15. The method of claim 14, wherein disengaging the split ring comprises:

engaging the detent of the split ring with a thread of the at least one set of threads on the mandrel; and forcing the split ring into a radially expanded position within the housing via the detent interacting with the thread such that the at least one set of threads of the split ring are disengaged from the at least one set of threads on the mandrel.

16. The method of claim 14, further comprising moving the connector with respect to the mandrel after disengaging the split ring to detach the connector from the mandrel.

17. The method of claim 13, further comprising preventing the split ring from rotating relative to the housing via a key coupled to the housing and extending into a cavity formed at a circumferential position where the split ring is split.

18. A system, comprising:

a tubular housing;

a mandrel removably disposed in the housing, wherein the mandrel comprises at least one set of threads formed on a radially external surface thereof;

a split ring disposed within the housing and biased in a radially inward direction, wherein the split ring comprises:

at least one set of threads formed on a radially internal surface of the split ring, wherein the at least one set of threads on the split ring is complementary to the at least one set of threads of the mandrel;

a detent formed on the radially internal surface of the split ring adjacent the at least one set of threads of the split ring, wherein the detent on the split ring acts as a cam to expand the split ring from a collapsed position to an expanded position upon engagement with a thread of the at least one set of threads of the mandrel while the split ring is rotated relative to the mandrel.

19. The system of claim 18, wherein the detent has a length in an axial direction greater than a pitch of any one thread in the at least one set of threads on the split ring.

20. The system of claim 18, further comprising a key coupled to the housing, wherein the key extends into a cavity formed at a circumferential position where the split ring is split, wherein the key prevents the split ring from rotating relative to the housing.

* * * * *